US006891133B2

(12) United States Patent
Shozo et al.

(10) Patent No.: US 6,891,133 B2
(45) Date of Patent: May 10, 2005

(54) COOKING APPARATUS

(75) Inventors: Kobayashi Shozo, Suwon (KR); Jung-Eui Hoh, Suwon (KR); Yun-Ic Hwang, Suwon (KR); Pung-Yeun Cho, Suwon (KR); Dong-Wok Ko, Suwon (KR); Kwang-Keun Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 13 days.

(21) Appl. No.: 10/669,504

(22) Filed: Sep. 25, 2003

(65) Prior Publication Data

US 2004/0182849 A1 Sep. 23, 2004

(30) Foreign Application Priority Data

Mar. 21, 2003 (KR) ..... 10-2003-0017753

(51) Int. Cl.[7] ..... H05B 3/10
(52) U.S. Cl. ..... 219/403; 219/543; 219/386
(58) Field of Search ..... 219/401–403, 219/385, 386, 410, 409, 543, 521, 541; 165/918, 919

(56) References Cited

U.S. PATENT DOCUMENTS 2,683,795 A * 7/1954 Sheidler ..... 219/403
2,976,386 A * 3/1961 Salton ..... 219/543
3,548,154 A * 12/1970 Christiansson ..... 219/403
4,459,470 A * 7/1984 Shlichta et al. ..... 219/543
4,517,446 A * 5/1985 Torning ..... 219/386

FOREIGN PATENT DOCUMENTS

JP 10-300098 11/1998

* cited by examiner

*Primary Examiner*—Teresa J. Walberg
(74) *Attorney, Agent, or Firm*—Staas & Halsey LLP

(57) ABSTRACT

A cooking apparatus to improve heating efficiency and to quickly cook food. The cooking apparatus includes a heater provided at a tray receiving food to be cooked and having a pair of terminals to supply power to the heater, and a plurality of sockets provided at a rear wall of a cooking cavity. When the tray is placed on a pair of support rails of the cooking cavity and the terminals of the heater are inserted into one of the sockets, the tray is directly heated by the heater to cook the food. The heater includes a conductive film coated on a lower surface of the tray, and first and second electrodes connected to the conductive film to be opposed to each other and connected to the terminals. The conductive film and the tray are heated by current flowing through the conductive film between the first and second electrodes.

32 Claims, 10 Drawing Sheets

COOKING APPARATUS

CROSS-REFERENCE TO RELATED APPLICATIONS

This application claims the benefit of Korean Application No. 2003-17753, filed Mar. 21, 2003, in the Korean Intellectual Property Office, the disclosure of which is incorporated herein by reference.

BACKGROUND OF THE INVENTION

1. Field of the Invention

The present invention relates to a cooking apparatus, and more particularly to a cooking apparatus, which includes a socket for power supply provided at a rear wall of its cooking cavity and a tray having a heater therein so as to cause the tray to generate heat by the heater, thereby improving heating efficiency.

2. Description of the Related Art

Generally, a cooking apparatus includes a cooking cavity to receive foods to be cooked, and a heating device installed in the cooking cavity or in an additional compartment isolated from the cooking cavity. For example, a microwave oven, which is a kind of cooking apparatus, includes a cooking cavity defining a space for cooking foods therein, and a machine room isolated from the cooking cavity having a magnetron generating microwaves. The microwaves are then introduced into the cooking cavity to cook the food.

In microwave ovens, where cooking is performed by only the microwaves from the magnetron, it is difficult to achieve a satisfactory cooking result because food is not evenly irradiated with the microwaves due to factors such as water content, distribution, and size of the food. Further, it is impossible to perform various kinds of cooking. To overcome such problems in conventional microwave ovens, a microwave oven has been proposed, in which the cooking cavity includes upper and lower heaters, to quickly and evenly cook food in the cooking cavity by heat generated from the upper and lower heaters as well as microwaves generated from the magnetron and to allow various kinds of cooking to be performed.

In the microwave oven with the upper and lower heaters, when the upper and lower heaters are turned on after a tray, on which food is placed, is received in the cooking cavity between the upper and lower heaters, the food can be cooked by heat generated from the upper and lower heaters, as in a grill oven.

However, in a conventional cooking apparatus provided with a plurality of heaters in its cooking cavity, the cooking cavity is not only reduced in its capacity but also complicated in its structure, thereby precluding efficient employment of the cooking cavity and increasing production cost and time.

In addition, in the conventional cooking apparatus, a tray in a cooking cavity is separated from a lower heater, so that heat generated from the lower heater must be transmitted to the food through the tray. Thus, heating efficiency is decreased and sufficient heat energy cannot be transmitted to a lower surface of the food, thereby increasing electric power consumption. Furthermore, since the amount of heat energy transmitted to upper and lower parts of the food are different from each other, the food must be periodically turned over to evenly cook upper and lower parts of the food, thereby causing the user inconvenience. Moreover, since a temperature at a part of the microwave oven around the lower heater becomes very high, a cooling fan operating at a high speed must be provided in the microwave oven to cool the heated part, thereby causing unpleasant noise due to the high-speed operation of the cooling fan.

Additionally, since a tray disposed to be spaced from a lower heater of the conventional cooking apparatus has uneven temperature distribution between its upper surface and its lower surface facing a lower heater, food placed on the tray is not evenly cooked.

SUMMARY OF THE INVENTION

Accordingly, it is an aspect of the present invention to provide a cooking apparatus, which is designed to increase heating efficiency and to quickly cook foods.

It is another aspect of the present invention to provide a cooking apparatus, having an increased effective space for its cooking cavity and which has a simplified structure for its cooking cavity.

It is a further aspect of the present invention to provide a cooking apparatus, which allows food to be evenly cooked and does not require that food be turned over during cooking.

Additional and/or other aspects and advantages of the invention will be set forth in part in the description which follows and, in part, will be obvious from the description, or may be learned by practice of the invention.

The foregoing and/or other aspects of the present invention are achieved by providing a cooking apparatus including a cooking cavity, at least one pair of support rails provided at both side walls of the cooking cavity, a tray placed on the support rails and on which food to be cooked is placed, a heater provided at the tray so as to cause the tray to be directly heated. Thus, the tray cooks the food by activation of the heater. The heater further provides a pair of terminals to be supplied with electric power. At least one socket is provided at a rear wall of the cooking cavity and connected to the pair of terminals of the heater to allow electric power to be supplied to the heater.

The heater may include a conductive film coated on a lower surface of the tray, and first and second electrodes connected to the conductive film and opposing each other, so that the conductive film is heated by electric current flowing through the conductive film between the first and second electrodes, thereby heating the tray.

In an aspect of the present invention, each of the first and second electrodes may be divided at its center portion, and both the divided electrode segments may be spaced from each other by a certain distance with a conductive wire connected therebetween, in order to prevent a center area of the conductive film from being heated more than its peripheral area.

In another aspect of the present invention, each of the first and second electrodes may be bent outward to have an arched shape, in order to prevent a center area of the conductive film from being heated more than its peripheral area.

The pair of terminals may be positioned at a side of the tray such that inner ends of the terminals are connected to the first and second electrodes and outer ends of the terminals are outwardly projected from the tray. Thus, when the tray is pushed into the cooking cavity along the support rails, the pair of terminals insert into the socket corresponding to the support rails to allow the tray to be heated by electric current flowing through the conductive film between the first and second electrode.

The lower surface of the tray may be covered with a cover plate to prevent the heater attached to the tray from being exposed.

Each of the pair of terminals may be surrounded with an insulating sheath except at its opposite ends, and the lower surface of the tray and the cover plate may be provided with a pair of grooves, respectively, to define a pair of holes, in which the pair of terminals are received.

Sealing material may be applied to the grooves of the tray and the cover plate so as to prevent moisture from infiltrating into the heater through the grooves.

The at least one pair of support rails may include a plurality of pairs of support rails, which are positioned at both side walls of the cooking cavity to be vertically spaced from one another by a certain distance. The at least one socket may include a plurality of sockets, which are positioned at the rear wall of the cooking cavity to correspond to the plurality of pairs of support rails.

The cooking apparatus may include an upper heater fixed to an upper portion of the rear wall of the cooking cavity to cook food in cooperation with the heater provided at the tray.

Each of the plurality of sockets may include a micro switch, which is turned on and off when the terminals are inserted into and separated from one of the sockets, to control electric current supplied to the heater by registering which of the sockets the heater is inserted into.

The tray may include a bottom plate and a side wall upwardly extended from a peripheral edge of the bottom plate, and the heater may be positioned on a lower surface of the bottom plate.

The cooking apparatus may include a grill plate placed on an upper end of the tray. The side wall of the tray may include a stepped portion at a predetermined height of its inner surface, which serves as a water level mark. Thus, when the heater of the tray is activated after the tray containing water is filled up to the stepped portion and having the grill plate with food placed thereon, the food on the grill plate is cooked in the cooking cavity by steam generated from the water contained in the tray.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
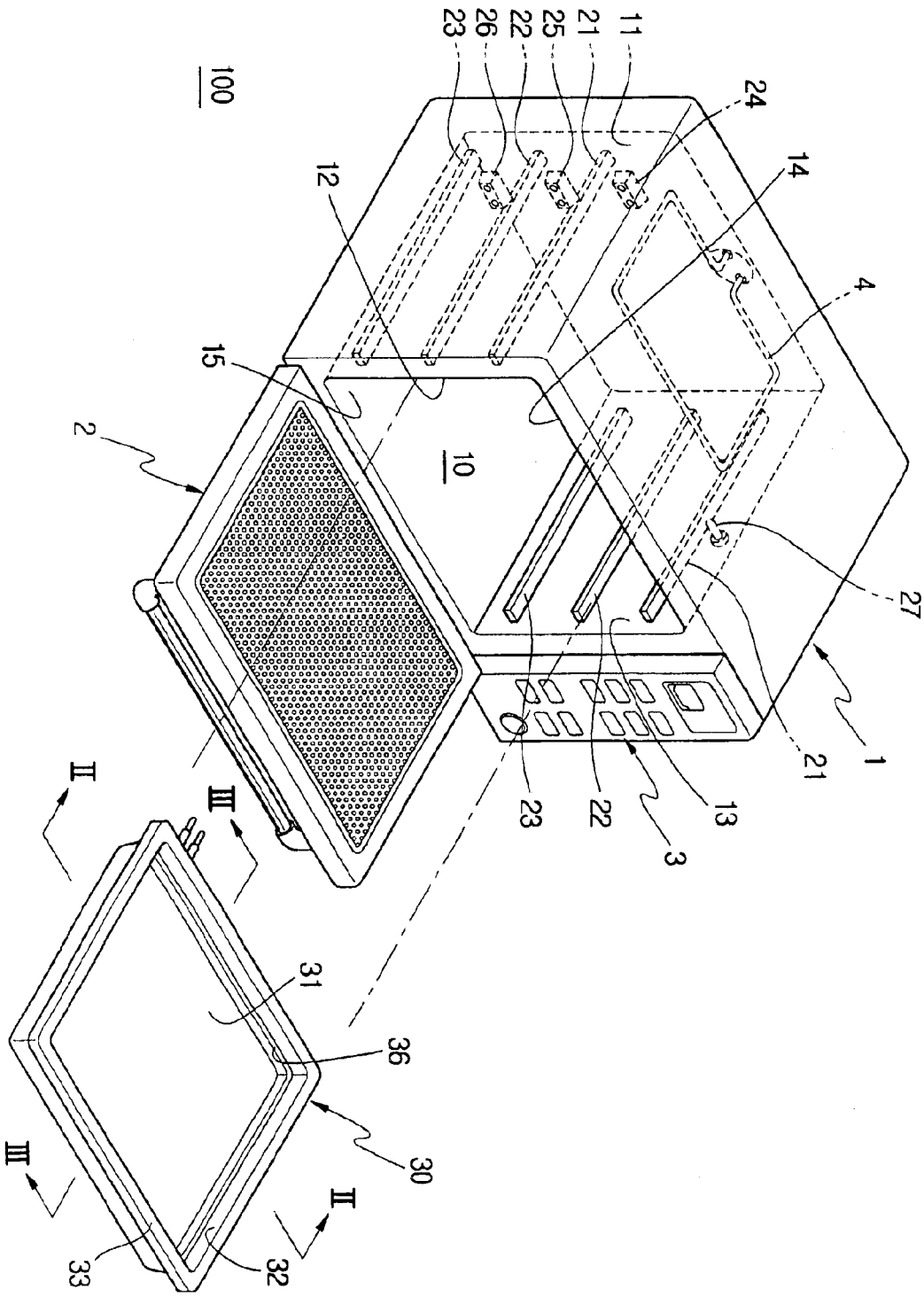
FIG. 1 is a perspective view of a cooking apparatus according to an embodiment of the present invention including a tray having a heater.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

FIG. 1 is a perspective view showing a cooking apparatus 100 according to an embodiment of the present invention, which is provided with a tray having a heater therein. The cooking apparatus 100 includes a cabinet 1 providing an appearance of the cooking apparatus 100, a cooking cavity 10 in the cabinet 1, a door 2 to open and close a front face of the cooking cavity 10, and a control panel 3 attached to a front face of the cabinet 1 adjacent to the door 2.

The cooking cavity 10 is defined by a rear wall 11, left and right walls 12 and 13, a top wall 14, and a bottom wall 15. The cooking cavity 10 is provided with a heater 4 close to the top wall 14 at the rear wall 11, to emit high-temperature heat downwardly.

The left and right walls 12 and 13 of the cooking cavity 10 are provided with a pair of upper support rails 21, a pair of intermediate support rails 22 and a pair of lower support rails 23, which are spaced from each other by a certain distance. The rear wall 11 of the cooking cavity 10 is provided with an upper socket 24, an intermediate socket 25, and a lower socket 26, which are positioned just below the upper, intermediate and lower support rails 21, 22 and 23, respectively.

Although the support rails 21, 22, and 23 and the sockets 24, 25, and 26 are described to be disposed at an upper position, an intermediate position and a lower position of the cooking cavity, the number and the position of the support rails 21, 22, and 23 and the sockets 24, 25, and 26 may be changed depending on a size of the cooking cavity.

The right wall 13 of the cooking cavity 10 is further provided with a temperature sensor 27 to detect a temperature in the cooking cavity 10 and thus control cooking of food in the cooking cavity 10.

A tray 30 according to the present invention, on which food is placed, is easily received in the cooking cavity 10.

The tray 30 includes a bottom plate 31 and an integral side wall 32 upwardly extended from a peripheral edge of the bottom plate 31 to have a substantially rectangular form. The side wall 32 is integrally provided at its upper end with a flange 33 extended outwardly by a certain length. Accordingly, the tray 30, on which food is placed, can be easily supported by any one pair of support rails 21, 22, and 23 among the upper, intermediate and lower support rails 21, 22 and 23 formed at the left and right walls 12 and 13, so as to cook the food in the cooking cavity 10.

Figure 2:
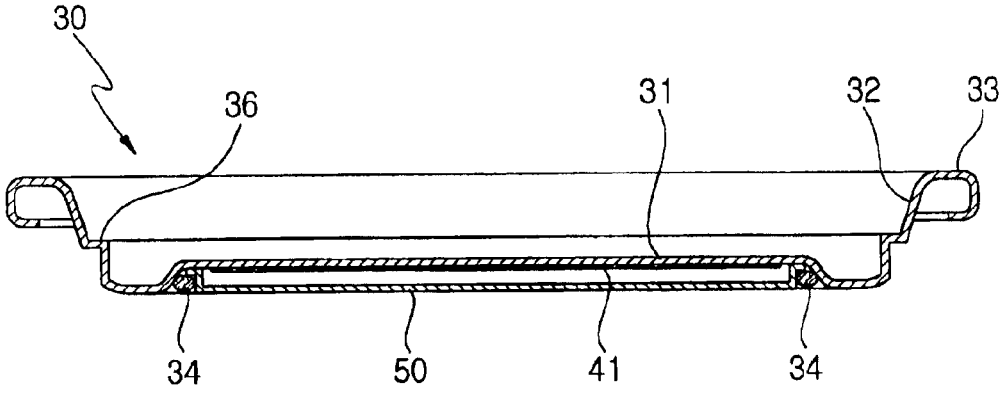
FIG. 2 is a cross-sectional view taken along line II—II of FIG. 1.
Figure 3:
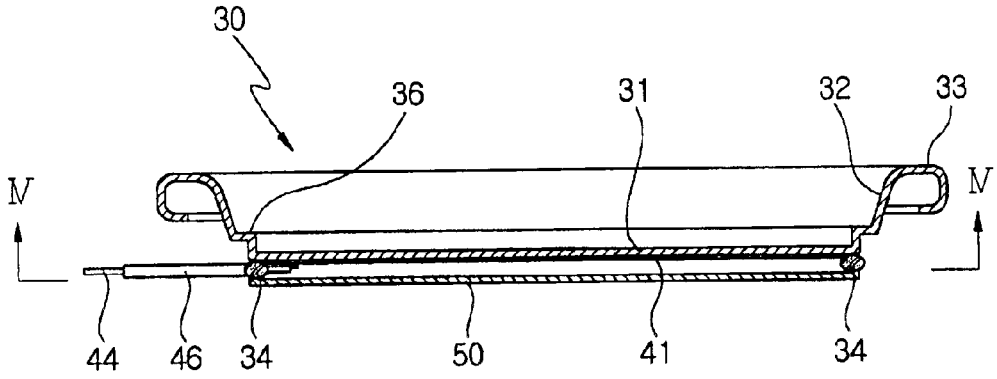
FIG. 3 is a cross-sectional view taken along line III—III of FIG. 1.
Figure 4:
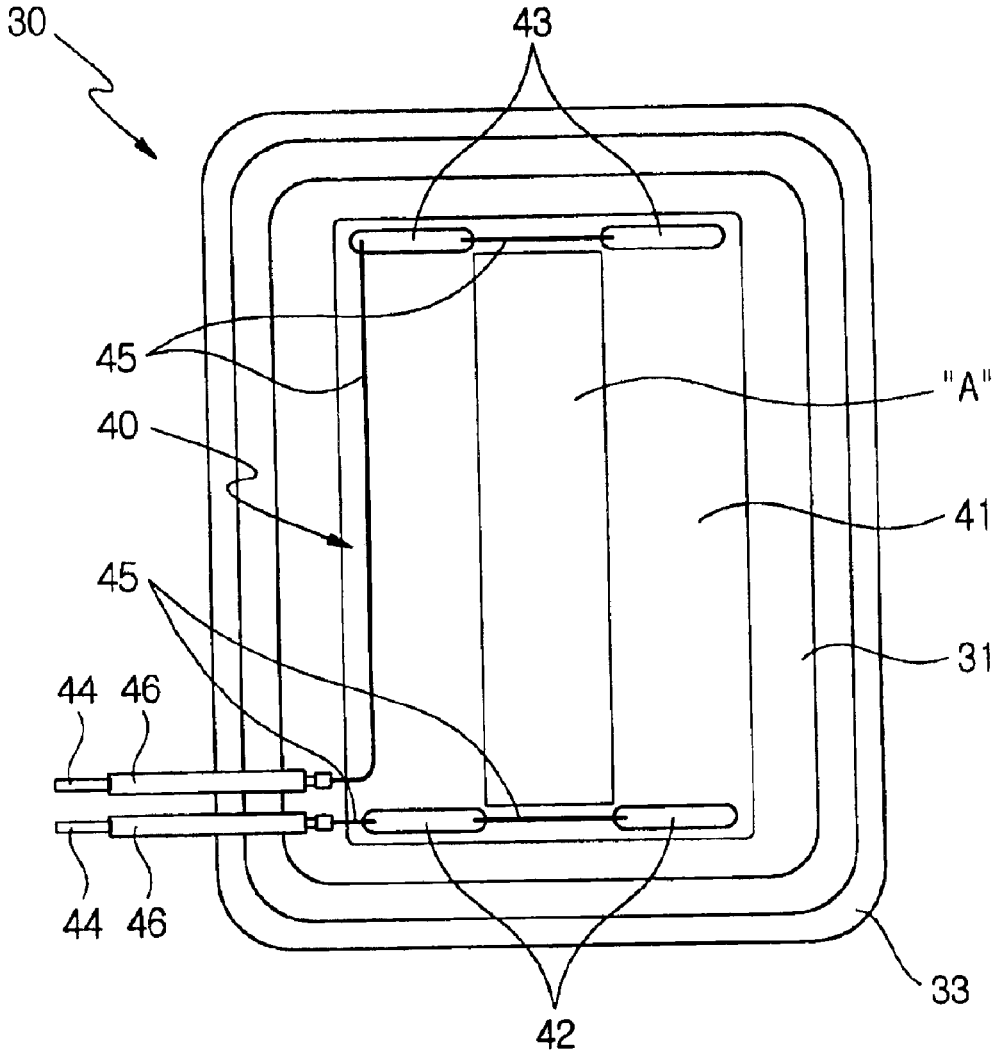
FIG. 4 is a cross-sectional view taken along line IV—IV of FIG. 3.

FIGS. 2 and 3 are side cross-sectional views showing a heater installed on an underside of the tray, which serves to cook food on the tray in cooperation with an upper heater fixedly installed on an upper portion of the cooking cavity, in which FIG. 2 is a cross-sectional view taken along line II—II of FIG. 1, and FIG. 3 is a cross-sectional view taken along line III—III of FIG. 1. FIG. 4 is a cross-sectional view taken along line IV—IV of FIG. 3.

As shown in FIGS. 2 through 4, the tray 30 includes a heater 40 shown in FIG. 4, at its bottom plate 31, which is formed into a plate-shape to provide a heating surface. The heater 40 includes a thin conductive film 41 coated on its underside, first and second electrodes 42 and 43 disposed at both sides of the conductive film 41 to face each other, as shown in FIG. 4, and a pair of terminals 44 shown in FIGS. 3 and 4, connected to the first and second electrodes 42 and 43 to allow electric power to be supplied to the heater 40.

The conductive film 41 is produced from material, which allows electric current to flow between the first and second electrodes 42 and 43 through the shortest path, to generate heat by itself, and radiate the heat. Accordingly, the overall bottom plate 31 of the tray 30 on which the conductive film 41 is coated serves as a heating surface.

The first electrodes 42 and the second electrodes 43 are electrically connected to the terminals 44. Consequently, when the terminals 44 are inserted in any one of the sockets 24, 25 and 26 of the cooking cavity 10 allowing external electric power to be supplied to the heater 40, the electric current flows between the first and second electrodes 42 and 43 through the conductive film 41. This causes the conductive film 41 to generate heat.

At this point, the center area "A" between the first and second electrodes 42 and 43 is heated to a relatively high temperature due to concentration of heat, compared to the remaining areas, thereby causing the bottom plate 31 of the tray 30 to be unevenly heated. To solve this problem, as shown in FIG. 4, each of the first and second electrodes 42 and 43 is divided into two electrodes to be spaced from each other by a certain distance. By the above-described structure, the center area "A" of the conductive film 41 is heated by heat transmitted from its surrounding areas, thereby allowing the conductive film 41 to be evenly heated to a high temperature.

Figure 10:
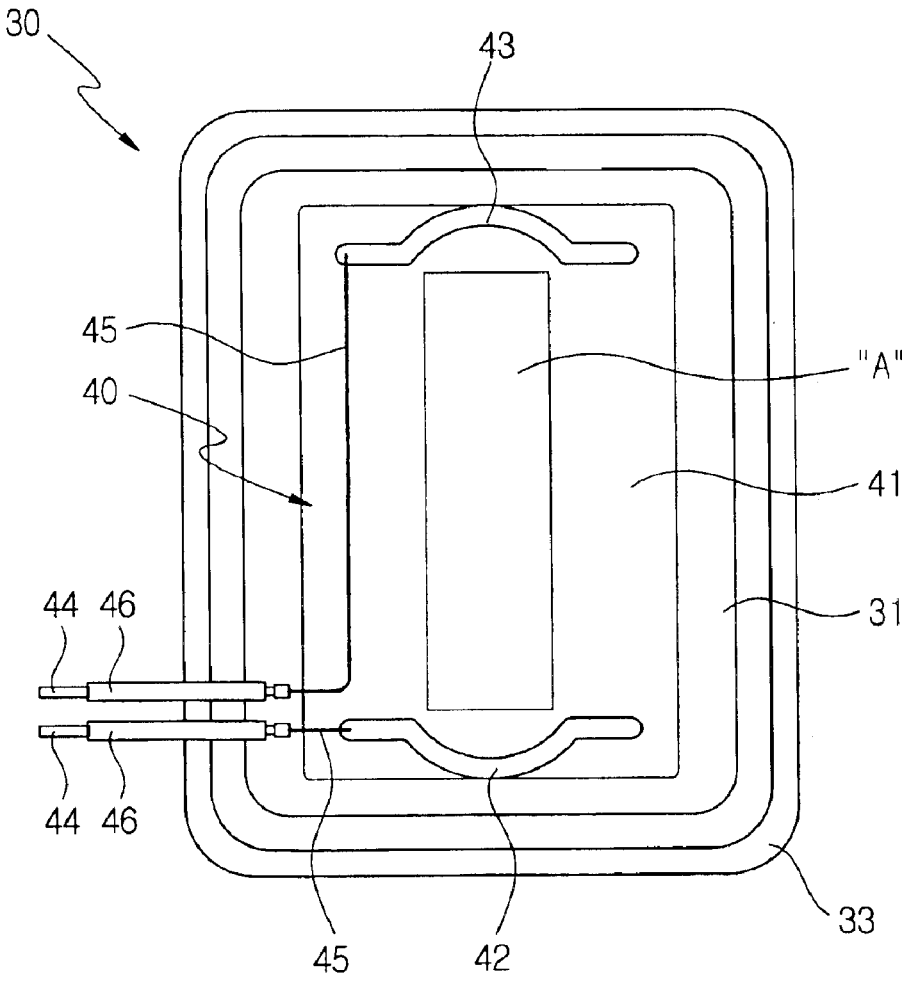
FIG. 10 is a cross-sectional view taken along line IV—IV of FIG. 3 and including illustrations of arch shaped electrodes.

Alternatively, the center area "A" of the conductive film 41 may be evenly heated without the division of each of the first and second electrodes 42 and 43. As shown in FIG. 10, in one of many alternative embodiments, each of the first and second electrodes 42 and 43 is bent outward to have an arched shape. Thus, a distance between the first and second electrodes 42 and 43 is increased at the center portion of the electrodes, compared to the structure at end portions of the electrodes. Accordingly, flow of electric current is relatively weakened at the center area "A" of the conductive film 41, thereby causing the conductive film 41 to be evenly heated.

It is understood that there are many other arrangements of the first and second electrodes 42 and 43 which would provide even heating of the conductive film 41.

The terminals 44 are positioned on the underside of the tray 30 such that inner ends of the terminals 44 are connected to the first and second electrodes 42 and 43 and outer ends of the terminals 44 are projected from the tray 30. Therefore, when the outer ends of the terminals 44 are inserted into any one of the sockets 24, 25 and 26 installed on the rear wall 11 of the cooking cavity 10, the first and second electrodes 42 and 43 are supplied with electric power. The terminals 44 are surrounded with insulating sheaths 46 to prevent electricity leakage.

With reference to FIG. 2, the tray 30 includes a cover plate 50 at its lower surface covering the heater 40 so as to protect the heater 40 from external impact. The cover plate 50 is attached to the lower surface of the tray 30 by sealing material 34 such as silicon. Accordingly, by attaching the cover plate 50 to the tray 30, the conductive film 41 and the first and second electrodes 42 and 43 can be protected from infiltration of moisture and from breakage by external impact.

As such, since the heater 40 according to the present invention is comprised of the conductive film 41, the first and second electrodes 42 and 43, and the terminals 44, the heater 40 can be remarkably decreased in its thickness and weight, thereby preventing considerable increase of overall thickness and weight of the tray 30. Furthermore, since the heater 40 is directly attached to the tray 30 so as to permit the tray 30 to generate heat by itself to cook food placed thereon, heating efficiency is considerably improved and power consumption is reduced.

The tray 30 having the heater 40 installed thereon is made of metallic material having excellent heat transfer properties, such as aluminum and stainless steel. Among the metallic materials, it is more preferable to use stainless steel in view of heat resistance.

A structure allowing the terminals 44 of the tray 30 having the heater 40 to be inserted into any one of the sockets 24, 25 and 26 provided at the cooking cavity 10 will now be described with reference to FIGS. 5 through 7.

Figure 5:
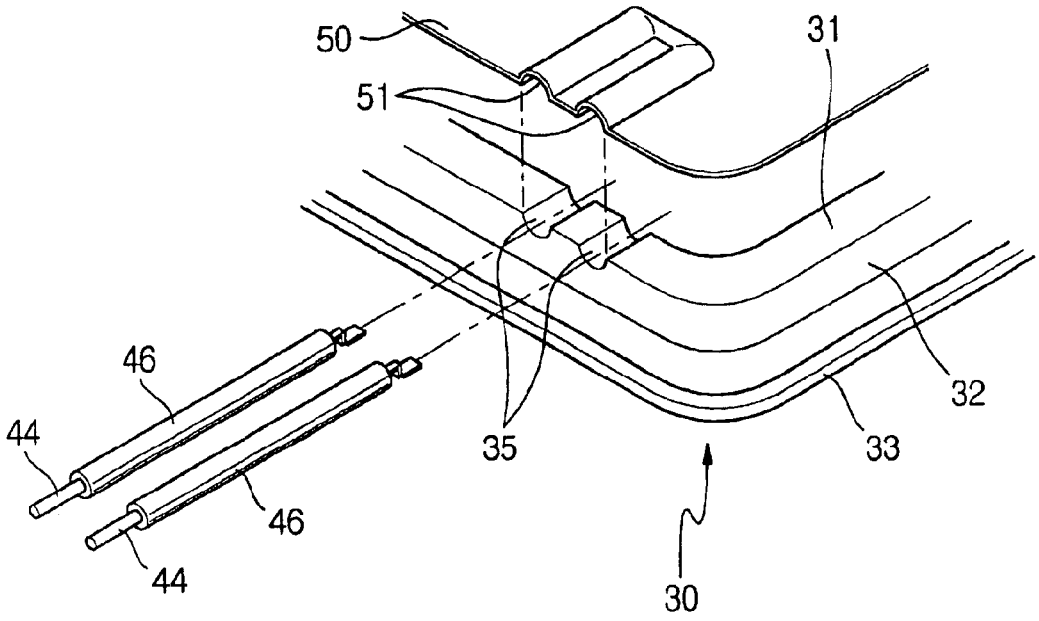
FIG. 5 is a fragmentary perspective view of a tray on which terminals are provided to supply electric power to a heater in the tray.

FIG. 5 is a fragmentary perspective view showing a part of the tray 30 in which the terminals 44 are installed to allow external power to be supplied to the heater. FIG. 6 is a cross-sectional view showing the terminals 44 inserted in the socket. FIG. 7 is a cross-sectional view taken along line VII—VII of FIG. 6.

As shown in FIG. 5, in order to install the terminals 44 of the heater 40, the tray 30 is provided at its lower surface with a pair of semi-circular grooves 35. The cover plate 50 is provided with a pair of semi-circular grooves 51 at its portion corresponding to the semi-circular grooves 35 of the tray 30. Therefore, two holes defined between the semi-circular grooves 35 of the tray 30 and the semi-circular grooves 51 of the cover plate 50 receive the insulating sheaths 46 attached to outer surfaces of the terminals 44. Inner ends of the terminals 44 are attached to a lower surface of the bottom plate 31 of the tray 30 by spot welding, so as to connect the terminals 44 to the first and second electrodes 42 and 43. Outer ends of the terminals 44 are extended from the tray 30 together with a part of the insulating sheaths 46 surrounding the terminals 44, to enable the terminals 44 to be inserted into any one of the sockets 24, 25 and 26.

Sealing material is applied to a gap between the terminals 44 and the semi-circular grooves 35 and 51 so as to prevent water or foreign substances from infiltrating into the heater 40 through the gap.

Figure 6:
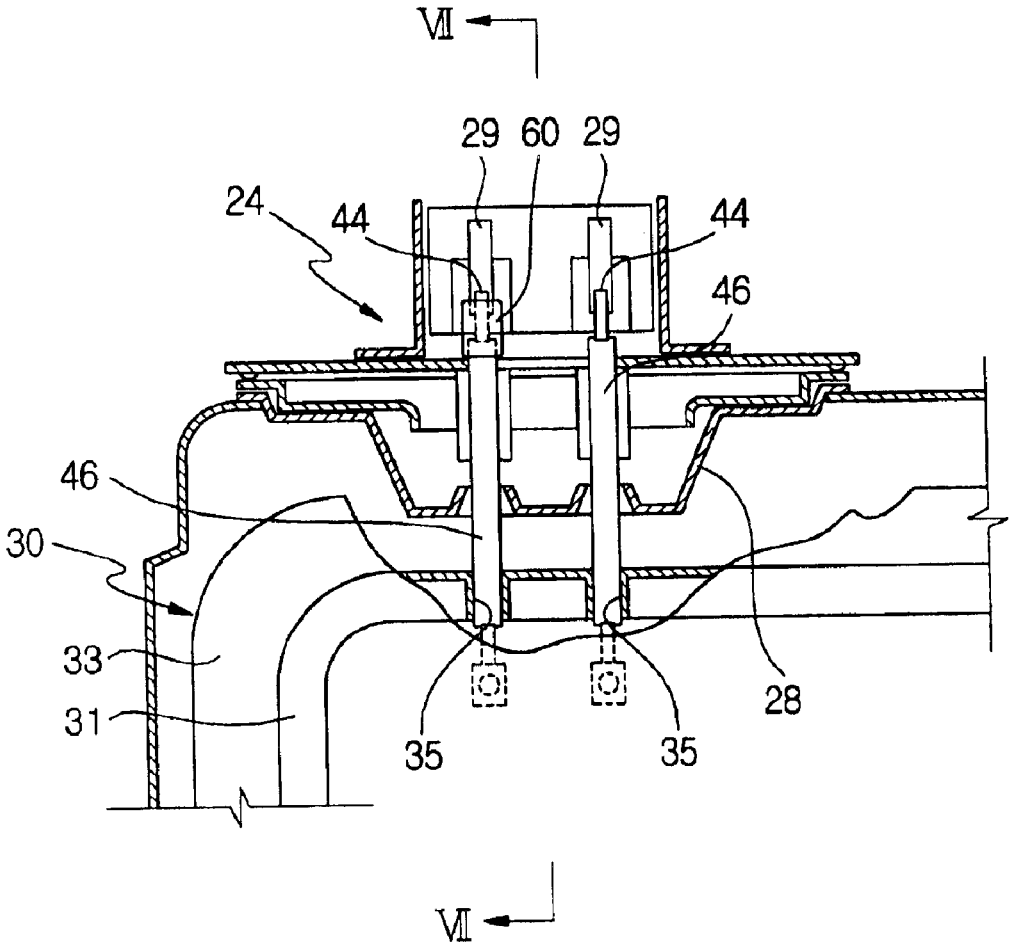
FIG. 6 is a cross-sectional view showing the terminals inserted in a socket provided at a rear wall of a cooking cavity.
Figure 7:
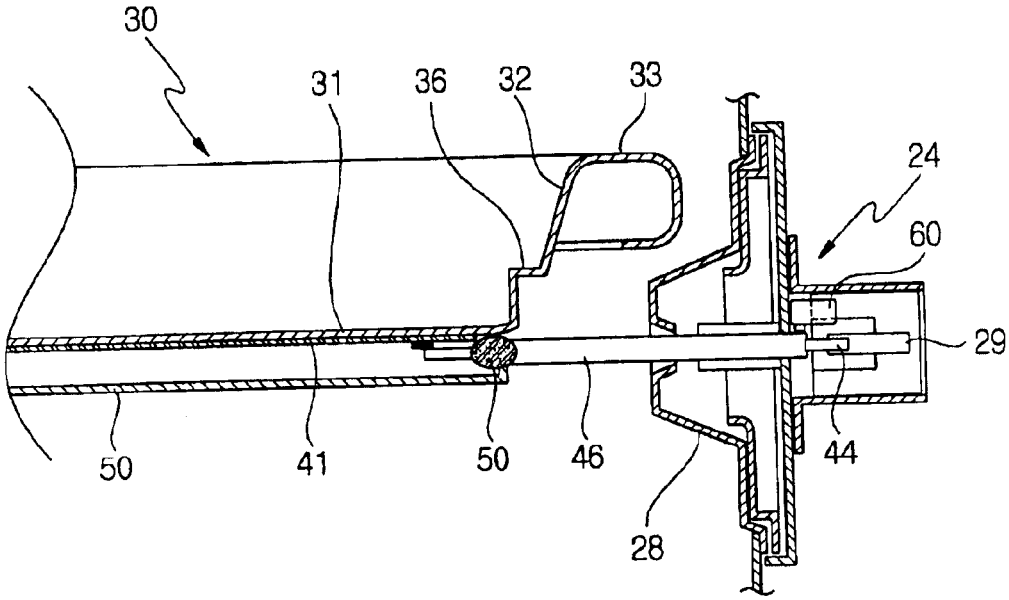
FIG. 7 is a cross-sectional view taken along line VII—VII of FIG. 6.

As shown in FIGS. 6 and 7, the socket 24 includes a guide cover 28 protruded from the rear wall 11 of the cooking cavity 10 to guide insertion of the terminals 44 of the heater 40 (sockets 25 and 26 are similarly constructed but not shown). Socket terminals 29 are provided in the guide cover 28 and connected to the inserted terminals 44 of the heater 40 to allow external power to be supplied to the heater 40. Each of the sockets 24, 25 and 26 is provided in the guide cover 28 with a micro switch 60, which is turned on and off when the terminals 44 of the heater 40 are inserted into and separated from the one socket. Accordingly, the cooking apparatus 100 can register which of the support rails 21, 22 and 23 the tray 30 is placed on, and can thus control current supplied to the heater 40.

More specifically, where the tray 30 is placed on the upper support rails 21, and the terminals 44 of the heater 40 are inserted into the upper socket 24, for the purpose of cooking of a small sized food, the tray 30 is positioned at a level closest to the upper heater 4 installed on the top wall of the cooking cavity 10. Consequently, even if the heater 40 of the tray 30 is applied with relatively little electric power, the food placed on the tray 30 can be quickly cooked.

Where the tray 30 is placed on the intermediate support rails 22, and the terminals 44 of the heater 40 are inserted into the intermediate socket 25, for the purpose of cooking of a moderate sized food, the tray 30 is positioned at a level moderately remote from the upper heater 4. Consequently, the heater 40 of the tray 30 is applied with moderate electric power to cook the food placed on the tray 30.

Finally, where the tray 30 is placed on the lower support rails 23, and the terminals 44 of the heater 40 are inserted into the lower socket 26, for the purpose of cooking of a large sized food, the tray 30 is positioned at a level farthest from the upper heater 4. In this case, the heater 40 of the tray 30 is applied with high electric power to cook the large sized food placed on the tray 30.

In another embodiment, the cooking apparatus 100 is provided with a manual cooking temperature adjustment system. This would allow the user to cook foods with varying sizes at varying temperature. For instance, a food, such as a steak requiring little space and high cooking temperatures could be cooked on the upper support rails.

An operation of steaming food according to the present invention will now be described with reference to FIGS. 8 and 9.

As described above, since the cooking apparatus 100 according to the present invention is designed to cook food by heat evenly generated through the bottom plate 31 of the tray 30 from the heater 40 attached to the bottom plate 31, the tray 30 may be used as a steaming container to steam food.

Figure 8:
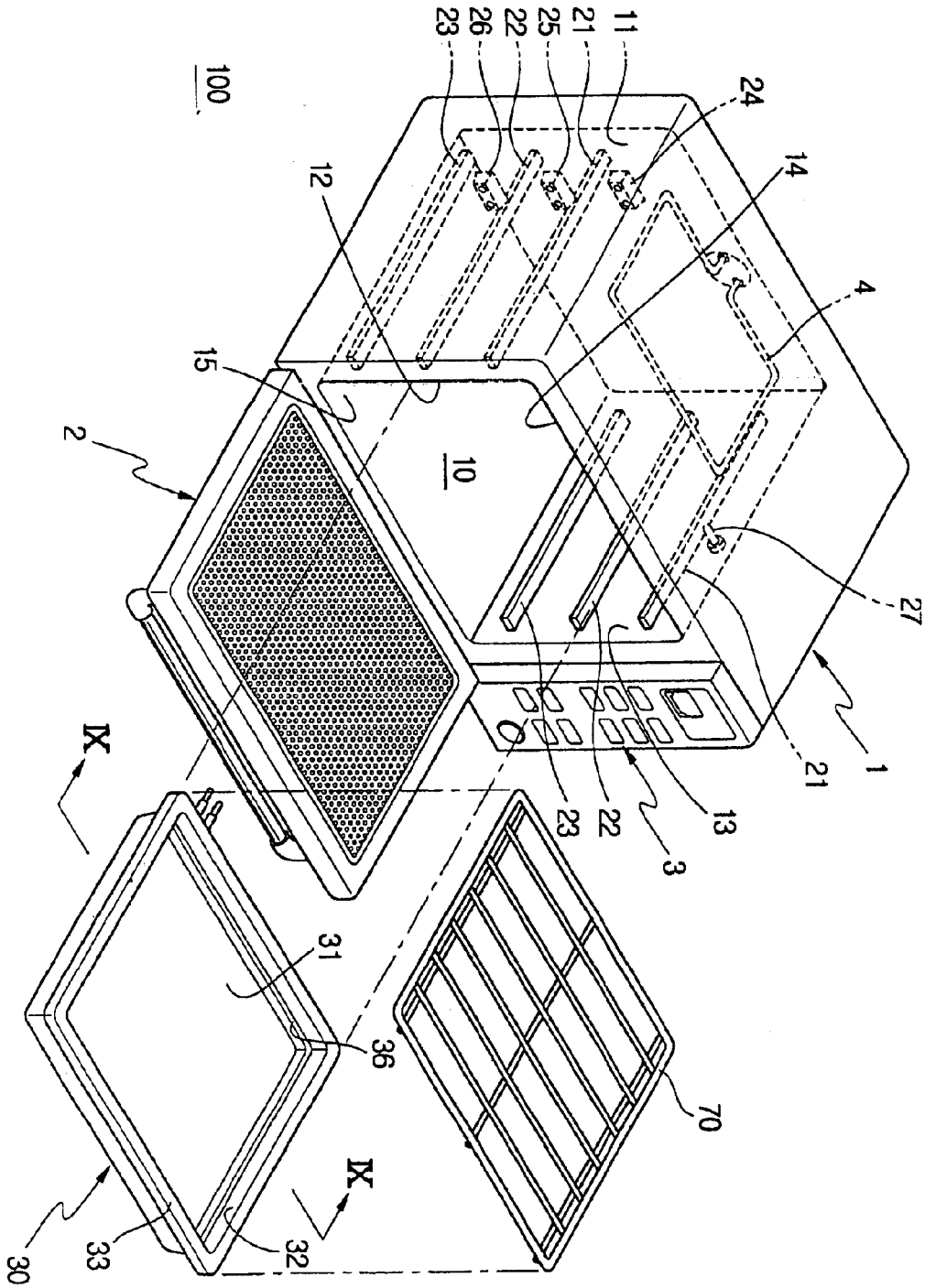
FIG. 8 is a perspective view of the cooking apparatus according to the present invention, in which the tray includes a grill plate to perform a grilling operation.
Figure 9:
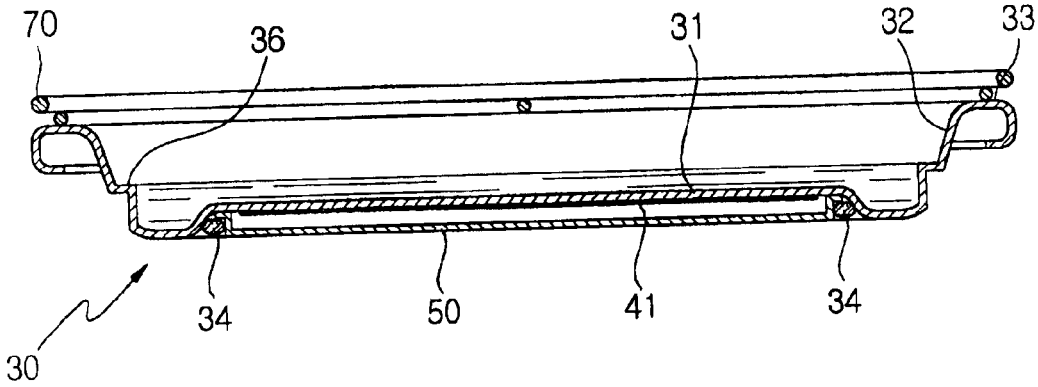
FIG. 9 is a cross-sectional view taken along line IX—IX of FIG. 8, in which the tray contains water to perform a grilling operation.

As shown in FIGS. 8 and 9, the tray 30 includes a stepped portion 36 formed at an inner surface of the side wall 32, and a grill plate 70 to be placed on an upper side of the tray 30. The tray 30 is first filled with water up to the stepped portion 36 serving as a water level mark, and the grill plate 70 is placed on the upper side of the tray 30 with food placed on the grill 70. The tray 30 is placed on one pair of support rails, which is selected among the support rails 21, 22 and 23 according to a size of the food, and then pushed into the cooking cavity 10. As the tray 30 is pushed into the cooking cavity 10, the terminals 40 of the heater 40 attached to the tray 30 are inserted into the socket corresponding to the selected support rails, thereby allowing electric power to be supplied to the heater 40.

With the supply of electric power, the heater 40 activates and causes the conductive film 41 to generate heat, and thus the bottom plate 31 of the tray 30 is evenly heated. Accordingly, the water contained in the tray 30 is vaporized by the heated bottom plate 31, thereby steaming the food placed on the grill plate 70.

As such, since the cooking apparatus 100 according to the present invention is constructed so the tray 30 is provided at its lower surface with the thin and light heater 40, and the heater 40 is selectively supplied with electric power from one of the sockets 24, 25 and 26, the cooking apparatus 100 may be used alone or in conjunction with another heating source such as a magnetron generating microwaves, depending on a kind and a size of food and a cooking manner.

As apparent from the above description, the present invention provides a cooking apparatus 100, which includes a tray having a heater to cook food placed on the tray in a direct heating manner. Accordingly, heating efficiency of the cooking apparatus 100 is considerably improved, and thus electric power consumption is dramatically reduced, compared to a conventional cooking apparatus.

In addition, since a tray of the cooking apparatus 100 according to the present invention is provided at its lower surface with a thin heater attached thereto, thereby dispensing with a necessity for providing an additional heater in a cooking cavity of the cooking apparatus 100, an effective cooking space in the cooking cavity is increased, and manufacturing cost and time is reduced. Additionally, it is not necessary to operate a cooling fan for cooling a lower space of the cooking cavity at high speed and for a long period of time.

Furthermore, since a tray of the cooking apparatus 100 according to the present invention is evenly heated throughout its area to directly heat food placed on the tray, a lower part of the food is quickly and evenly cooked, and a procedure of turning food over during a grilling operation is not necessary.

Additionally, since a tray of the cooking apparatus 100 according to the present invention is directly heated at its bottom plate, a steaming operation can be easily performed where the tray contains water therein.

Although an embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A cooking apparatus comprising:

a cooking cavity;

at least one pair of support rails respectively included at both side walls of the cooking cavity;

a tray on which food is placed;

a heater to directly heat the tray to cook the food by activation of the heater, having a pair of electricity providing terminals, first and second electrodes to provide a circuit along which the electricity may flow, and a conductive film, on a lower surface of the tray, to heat the tray as electricity flows along paths through the conductive film that are as short as possible; and at least one socket included at a rear wall of the cooking cavity to allow the electricity to be supplied to the heater when the terminals are connected to the sockets.

2. The cooking apparatus as set forth in claim 1, wherein the conductive film is coated on a lower surface of the tray.

3. The cooking apparatus as set forth in claim 2, wherein each of the first and second electrodes is divided at a center portion thereof, the divided electrode segments spaced from each other by a distance with a conductive wire connected therebetween to prevent a center area of the conductive film from being heated more than peripheral area thereof.

4. The cooking apparatus as set forth in claim 2, wherein each of the first and second electrodes is arch shaped, to prevent a center area of the conductive film from being heated more than a peripheral area thereof.

5. The cooking apparatus as set forth in claim 2, wherein the pair of terminals are positioned at a side of the tray such that inner ends of the terminals are connected to the first and second electrodes and outer ends of the terminals are outwardly projected from the tray, and when the tray is pushed into the cooking cavity along the support rails, the pair of terminals are inserted into the socket corresponding to the support rails to allow the tray to be heated by electric current flowing through the conductive film between the first and second electrodes.

6. The cooking apparatus as set forth in claim 5, wherein the lower surface of the tray is covered with a cover plate so as to prevent the heater attached to the tray from being exposed.

7. The cooking apparatus as set forth in claim 6, wherein each of the pair of terminals, except the outer end, is surrounded with an insulating sheath, and the lower surfaces of the tray and the cover plate include a pair of grooves, respectively, to define a pair of holes, in which the pair of terminals are received.

8. The cooking apparatus as set forth in claim 7, wherein sealing material is applied to the grooves of the tray and the cover plate to prevent moisture from infiltrating into the heater.

9. The cooking apparatus as set forth in claim 2, wherein:

the at least one pair of support rails include a plurality of pairs of support rails, which are positioned at both side walls of the cooking cavity to be vertically spaced from one another by a distance, and the at least one socket includes a plurality of sockets, which are positioned at the rear wall of the cooking cavity to correspond to the positions of the plurality of pairs of support rails.

10. The cooking apparatus as set forth in claim 9, further comprising an upper heater fixed to an upper portion of the rear wall of the cooking cavity to cook food in cooperation with the heater provided at the tray.

11. The cooking apparatus as set forth in claim 9, wherein each of the plurality of sockets includes a micro switch, which is turned on and off when the terminals are inserted into and separated from a corresponding one of the sockets, so as to control electric current supplied to the heater by registering which of the sockets the heater is inserted into.

12. The cooking apparatus as set forth in claim 1, wherein the tray includes a bottom plate and a side wall upwardly extended from a peripheral edge of the bottom plate, and the heater is positioned on a lower surface of the bottom plate.

13. The cooking apparatus as set forth in claim 12, further comprising a grill plate placed on an upper end of the tray, wherein the side wall of the tray includes a stepped portion at a predetermined height of an inner surface thereof, wherein when the heater is activated and the tray is filled with water steam cooks the food.

14. A cooking apparatus, comprising:

a substantially rectangular cooking space;

a heating element having a pair of electricity providing terminals, first and second electrodes to provide a circuit along which the electricity may flow, and a conductive film through which the electricity flows along oaths that are as short as possible, the conductive film to generate heat as a result to heat the heating element;

a heating system including a socket at a certain position within the cooking space corresponding to a desired cooking position, the socket cooperable with the pair of terminals to provide electricity to the heating element via the pair of terminals; and a support system which supports the heating element in a position corresponding to the position of the socket.

15. The cooking apparatus as set forth in claim 14, wherein:

the heating element comprises a tray, and the conductive film coats a lower surface of the tray such that the tray generates heat by itself to cook food placed thereon.

16. The cooking apparatus as set forth in claim 15, wherein the first and second electrodes connect with to the conductive film.

17. The cooking apparatus as set forth in claim 16, wherein the first and second electrodes oppose each other.

18. The cooking apparatus as set forth in claim 17, wherein electric current flowing through the conductive film between the first and second electrodes directly heats the conductive film.

19. The cooking apparatus as set forth in claim 16, wherein each of the first and second electrodes is divided at a center portion.

20. The cooking apparatus as set forth in claim 19, wherein the divided electrode segments are set apart and include a conductive wire connected therebetween.

21. The cooking apparatus element as set forth in claim 16, wherein each of the first and second electrodes is bent outward to have an arched shape.

22. The cooking apparatus as set forth in claim 16, wherein inner ends of the terminals are connected to the first and second electrodes, respectively, and outer ends of the terminals project outwardly.

23. The cooking apparatus as set forth in claim 22, wherein when the heating element is supported by the support system, the terminals cooperate with the socket to power the conductive film.

24. The cooking apparatus as set forth in claim 23, wherein the terminals, except for the outer end of the terminals, are surrounded with insulating sheaths.

25. The cooking apparatus as set forth in claim 24, further comprising:

a pair of semi-circular grooves in positions in the lower surface of the heating element; and a cover plate covering a lower surface of the heating element, wherein the cover plate includes a pair of semi-circular grooves in position corresponding to the positions of the grooves in the lower surface of the heating element, wherein the grooves in the lower surface of the heating element and the grooves in the cover plate receive the insulating sheaths.

26. The cooking apparatus as set forth in claim 25, further comprising a sealing material applied to the grooves in the lower surface of the heating element and the grooves in the cover plate to prevent moisture from infiltrating into the heater.

27. The cooking apparatus as set forth in claim 14, wherein the support system comprises a plurality of pairs of support rails vertically spaced from one another by a distance.

28. The cooking apparatus as set forth in claim 27, wherein the socket is plural in number and positions of the sockets correspond to vertical positions of the support rails.

29. The cooking apparatus as set forth in claim 28, further comprising an upper heater fixed to an upper portion of a rear wall of the rectangular cooking space.

30. The cooking apparatus as set forth in claim 28, wherein the sockets comprise micro switches turning on when the sockets cooperate with the terminals, and off when the sockets do not cooperate with the terminals.

31. The cooking apparatus as set forth in claim 14, wherein the heating element comprises:

a bottom plate and a side wall upwardly extended from a peripheral edge of the bottom plate, and a conductive film on a lower surface of the bottom plate.

32. The cooking apparatus as set forth in claim 31, wherein the heating element comprises a grill plate on an upper surface of the heating element, wherein the side wall of the tray includes a stepped portion at a predetermined height of its inner surface, wherein when the heating element is activated and having food placed on the grill plate, steam generated from the water contained in the tray cooks the food.

* * * * *

UNITED STATES PATENT AND TRADEMARK OFFICE

CERTIFICATE OF CORRECTION

PATENT NO. : 6,891,133 B2
DATED : May 10, 2005
INVENTOR(S) : Kobayashi Shozo et al.

It is certified that error appears in the above-identified patent and that said Letters Patent is hereby corrected as shown below:

Column 9,
Line 46, change "oaths" to -- paths --.

Signed and Sealed this

Fourth Day of April, 2006

JON W. DUDAS
*Director of the United States Patent and Trademark Office*